US008898980B2

(12) United States Patent
Hohmann, Jr.

(10) Patent No.: US 8,898,980 B2
(45) **Date of Patent: *Dec. 2, 2014**

(54) PULLOUT RESISTANT PINTLE AND ANCHORING SYSTEM UTILIZING THE SAME

(75) Inventor: Ronald P. Hohmann, Jr., Hauppauge, NY (US)

(73) Assignee: Mitek Holdings, Inc., Wilmington, DE (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/620,882

(22) Filed: Sep. 15, 2012

(65) Prior Publication Data

US 2014/0075856 A1 Mar. 20, 2014

(51) Int. Cl.
*E04B 1/16* (2006.01)

(52) U.S. Cl.
USPC ..... 52/379; 52/513; 52/712

(58) Field of Classification Search
USPC ..... 52/379, 513, 712
See application file for complete search history.

(56) References Cited

U.S. PATENT DOCUMENTS

| | | | |
|---|---|---|---|
| 819,869 | A | 5/1906 | Dunlap |
| 903,000 | A | 11/1908 | Priest, Jr. |
| 1,170,419 | A | 2/1916 | Coon et al. |
| RE15,979 | E | 1/1925 | C. P. Schaefer et al. |
| 1,794,684 | A | 3/1931 | Handel |
| 1,936,223 | A | 11/1933 | S. C. Awbrey |
| 2,058,148 | A | 10/1936 | Hard |
| 2,097,821 | A | 11/1937 | Mathers |
| 2,280,647 | A | 4/1942 | Hawes |
| 2,300,181 | A | 10/1942 | Spaight |
| 2,403,566 | A | 7/1946 | Thorp et al. |
| 2,413,772 | A | 1/1947 | Morehouse |
| 2,605,867 | A | 8/1952 | Goodwin |
| 2,780,936 | A | 2/1957 | Hillberg |
| 2,898,758 | A | 8/1959 | H. G. Henrickson |
| 2,929,238 | A | 3/1960 | Kaye |
| 2,966,705 | A | 1/1961 | Massey |
| 2,999,571 | A | 9/1961 | Huber |

(Continued)

FOREIGN PATENT DOCUMENTS

| | | |
|---|---|---|
| CH | 279209 | 3/1952 |
| EP | 0199595 B1 | 3/1995 |

(Continued)

OTHER PUBLICATIONS

ASTM Standard E754-80 (2006), Standard Test Method for Pullout Resistance of Ties and Anchors Embedded in Masonry Mortar Joints, ASTM International, 8 pages, West Conshohocken, Pennsylvania, United States.

(Continued)

*Primary Examiner* — Brian Glessner
*Assistant Examiner* — Babajide Demuren
(74) *Attorney, Agent, or Firm* — Silber & Fridman

(57) ABSTRACT

A high-strength pullout resistant pintle and anchoring system employing the same is disclosed. The modified veneer tie utilizes ribbon pintles formed from a wire formative construct that is cold-worked with the resultant body having substantially semicircular edges and flat surfaces therebetween. The edges are aligned to receive compressive forces transmitted from the outer wythe. The ribbon pintles hereof, when part of the anchoring system, interengage with receptor portions of a wall anchor and are dimensioned to preclude significant lateral, vertical and horizontal movement.

20 Claims, 7 Drawing Sheets

(56) References Cited

U.S. PATENT DOCUMENTS 3,030,670 A 4/1962 Bigelow
3,183,628 A 5/1965 Smith
3,254,736 A 6/1966 Gass
3,277,626 A 10/1966 Brynjolfsson et al.
3,300,939 A 1/1967 Brynjolfsson et al.
3,309,828 A 3/1967 Tribble
3,310,926 A 3/1967 Brandreth et al.
3,341,998 A 9/1967 Lucas
3,377,764 A 4/1968 Storch
3,478,480 A 11/1969 Swenson
3,563,131 A 2/1971 Ridley, Sr.
3,568,389 A 3/1971 Gulow
3,640,043 A 2/1972 Querfeld et al.
3,964,226 A 6/1976 Hala et al.
3,964,227 A 6/1976 Hala
4,021,990 A 5/1977 Schwalberg
4,227,359 A 10/1980 Schlenker
4,238,987 A 12/1980 Siebrecht-Reuter
4,305,239 A 12/1981 Geraghty
4,373,314 A 2/1983 Allan
4,382,416 A 5/1983 Kellogg-Smith
4,424,745 A 1/1984 Magorian et al.
4,438,611 A 3/1984 Bryant
4,473,984 A 10/1984 Lopez
4,482,368 A 11/1984 Roberts
4,571,909 A 2/1986 Berghuis et al.
4,596,102 A 6/1986 Catani et al.
4,598,518 A 7/1986 Hohmann
4,606,163 A 8/1986 Catani
4,622,796 A 11/1986 Aziz et al.
4,628,657 A 12/1986 Ermer et al.
4,636,125 A 1/1987 Burgard
4,640,848 A 2/1987 Cerdan-Diaz et al.
4,660,342 A 4/1987 Salisbury
4,703,604 A 11/1987 Muller
4,708,551 A 11/1987 Richter et al.
4,738,070 A 4/1988 Abbott et al.
4,764,069 A 8/1988 Reinwall et al.
4,819,401 A 4/1989 Whitney, Jr.
4,827,684 A 5/1989 Allan
4,843,776 A 7/1989 Guignard
4,852,320 A 8/1989 Ballantyne
4,869,038 A 9/1989 Catani
4,869,043 A 9/1989 Hatzinikolas et al.
4,875,319 A 10/1989 Hohmann
4,911,949 A 3/1990 Iwase et al.
4,922,680 A 5/1990 Kramer et al.
4,946,632 A 8/1990 Pollina
4,955,172 A 9/1990 Pierson
5,063,722 A 11/1991 Hohmann
5,099,628 A 3/1992 Noland et al.
5,207,043 A 5/1993 McGee et al.
5,307,602 A 5/1994 Lebraut
5,392,581 A 2/1995 Hatzinikolas et al.
5,408,798 A 4/1995 Hohmann
5,440,854 A 8/1995 Hohmann
5,454,200 A 10/1995 Hohmann
5,456,052 A 10/1995 Anderson et al.
5,490,366 A 2/1996 Burns et al.
5,598,673 A 2/1997 Atkins
5,634,310 A 6/1997 Hohmann
5,669,592 A 9/1997 Kearful
5,671,578 A 9/1997 Hohmann
5,673,527 A 10/1997 Coston et al.
5,755,070 A 5/1998 Hohmann
5,816,008 A 10/1998 Hohmann
5,819,486 A 10/1998 Goodings
5,845,455 A * 12/1998 Johnson, III ..... 52/713
6,000,178 A 12/1999 Goodings
6,125,608 A 10/2000 Charlson
6,209,281 B1 4/2001 Rice
6,279,283 B1 8/2001 Hohmann et al.
6,284,311 B1 9/2001 Gregorovich et al.
6,332,300 B1 12/2001 Wakai
6,351,922 B1 3/2002 Burns et al.
6,367,219 B1 4/2002 Quinlan
6,612,343 B2 9/2003 Camberlin et al.
6,627,128 B1 9/2003 Boyer
6,668,505 B1 12/2003 Hohmann et al.
6,686,301 B2 2/2004 Li et al.
6,735,915 B1 5/2004 Johnson, III
6,739,105 B2 5/2004 Fleming
6,789,365 B1 9/2004 Hohmann et al.
6,817,147 B1 * 11/2004 MacDonald ..... 52/220.7
6,827,969 B1 12/2004 Skoog et al.
6,837,013 B2 1/2005 Foderberg et al.
6,851,239 B1 2/2005 Hohmann et al.
6,925,768 B2 8/2005 Hohmann et al.
6,941,717 B2 9/2005 Hohmann et al.
6,968,659 B2 11/2005 Boyer
7,007,433 B2 3/2006 Boyer
7,017,318 B1 3/2006 Hohmann et al.
7,043,884 B2 5/2006 Moreno
7,059,577 B1 6/2006 Burgett
D527,834 S 9/2006 Thimons et al.
7,147,419 B2 12/2006 Balbo Di Vinadio
7,152,382 B2 12/2006 Johnson, III
7,171,788 B2 2/2007 Bronner
7,178,299 B2 2/2007 Hyde et al.
D538,948 S 3/2007 Thimons et al.
7,225,590 B1 6/2007 diGirolamo et al.
7,325,366 B1 2/2008 Hohmann, Jr. et al.
7,334,374 B2 2/2008 Schmid
7,374,825 B2 5/2008 Hazel et al.
7,415,803 B2 8/2008 Bronner
7,469,511 B2 12/2008 Wobber
7,481,032 B2 1/2009 Tarr
7,552,566 B2 6/2009 Hyde et al.
7,562,506 B2 7/2009 Hohmann, Jr.
7,587,874 B2 9/2009 Hohmann, Jr.
7,735,292 B2 * 6/2010 Massie ..... 52/742.14
7,748,181 B1 7/2010 Guinn
7,788,869 B2 9/2010 Voegele, Jr.
D626,817 S 11/2010 Donowho et al.
7,845,137 B2 12/2010 Hohmann, Jr.
8,037,653 B2 10/2011 Hohmann, Jr.
8,051,619 B2 11/2011 Hohmann, Jr.
8,096,090 B1 * 1/2012 Hohmann et al. ..... 52/513
8,109,706 B2 2/2012 Richards
8,122,663 B1 2/2012 Hohmann, Jr. et al.
8,201,374 B2 6/2012 Hohmann, Jr.
8,209,934 B2 7/2012 Pettingale
8,215,083 B2 7/2012 Toas et al.
8,291,672 B2 10/2012 Hohmann, Jr.
8,347,581 B2 1/2013 Doerr et al.
8,375,667 B2 2/2013 Hohmann, Jr.
8,418,422 B2 4/2013 Johnson, III
8,511,041 B2 8/2013 Fransen
8,516,763 B2 8/2013 Hohmann, Jr.
8,516,768 B2 8/2013 Johnson, III
8,544,228 B2 10/2013 Bronner
8,555,587 B2 10/2013 Hohmann, Jr.
8,555,596 B2 10/2013 Hohmann, Jr.
8,596,010 B2 12/2013 Hohmann, Jr.
8,613,175 B2 12/2013 Hohmann, Jr.
8,667,757 B1 3/2014 Hohmann, Jr.
2001/0054270 A1 12/2001 Rice
2002/0100239 A1 8/2002 Lopez
2003/0121226 A1 7/2003 Bolduc
2003/0217521 A1 11/2003 Richardson et al.
2004/0083667 A1 5/2004 Johnson, III
2004/0216408 A1 11/2004 Hohmann, Jr.
2004/0216413 A1 11/2004 Hohmann et al.
2004/0216416 A1 11/2004 Hohmann et al.
2004/0231270 A1 11/2004 Collins et al.
2005/0279043 A1 12/2005 Bronner
2006/0198717 A1 9/2006 Fuest
2006/0242921 A1 11/2006 Massie
2006/0251916 A1 11/2006 Arikawa et al.
2008/0092472 A1 4/2008 Doerr et al.
2008/0141605 A1 6/2008 Hohmann
2008/0222992 A1 9/2008 Hikai et al.
2009/0133351 A1 5/2009 Wobber
2009/0133357 A1 5/2009 Richards

(56) References Cited

U.S. PATENT DOCUMENTS

| | | | | |
|---|---|---|---|---|
| 2010/0037552 | A1 | 2/2010 | Bronner | |
| 2010/0101175 | A1 | 4/2010 | Hohmann | |
| 2010/0192495 | A1 | 8/2010 | Huff et al. | |
| 2010/0257803 | A1 | 10/2010 | Hohmann, Jr. | |
| 2011/0023748 | A1 | 2/2011 | Wagh et al. | |
| 2011/0041442 | A1 | 2/2011 | Bui | |
| 2011/0047919 | A1 | 3/2011 | Hohmann, Jr. | |
| 2011/0061333 | A1 | 3/2011 | Bronner | |
| 2011/0083389 | A1 | 4/2011 | Bui | |
| 2011/0146195 | A1 | 6/2011 | Hohmann, Jr. | |
| 2011/0173902 | A1 | 7/2011 | Hohmann, Jr. et al. | |
| 2011/0277397 | A1 | 11/2011 | Hohmann, Jr. | |
| 2012/0186183 | A1 | 7/2012 | Johnson, III | |
| 2012/0285111 | A1* | 11/2012 | Johnson, III | 52/379 |
| 2013/0008121 | A1 | 1/2013 | Dalen | |
| 2013/0074435 | A1 | 3/2013 | Hohmann, Jr. | |
| 2013/0232893 | A1 | 9/2013 | Hohmann, Jr. | |
| 2013/0232909 | A1 | 9/2013 | Curtis et al. | |
| 2013/0247483 | A1 | 9/2013 | Hohmann, Jr. | |
| 2013/0247484 | A1 | 9/2013 | Hohmann, Jr. | |
| 2013/0247498 | A1 | 9/2013 | Hohmann, Jr. | |
| 2013/0340378 | A1 | 12/2013 | Hohmann, Jr. | |
| 2014/0000211 | A1 | 1/2014 | Hohmann, Jr. | |

FOREIGN PATENT DOCUMENTS

| | | | | |
|---|---|---|---|---|
| GB | 1575501 | | 9/1980 | |
| GB | 2069024 | A | 8/1981 | |
| GB | 2246149 | A | 1/1992 | |
| GB | 2265164 | A | 9/1993 | |
| GB | 2459936 | B | 3/2013 | |
| WO | WO 9117327 | A1 * | 11/1991 | E04B 2/00 |

OTHER PUBLICATIONS

Building Envelope Requirements, 780 CMR sec. 1304.0 et seq. of Chapter 13, Jan. 1, 2001, 19 pages, Boston, Massachusetts, United States.

Building Code Requirements for Masonry Structures, TMS 402-11/ACI 530-11/ASCE 5-11, Chapter 6, 12 pages.

Hohmann & Barnard, Inc.; Product Catalog, 2009, 52 pages, Hauppauge, New York, United States.

ASTM Standard Specification A951/A951M-11, Table 1, Standard Specification for Steel Wire for Masonry Joint Reinforcement, Nov. 14, 2011, 6 pages, West Conshohocken, Pennsylvania, United States.

State Board of Building Regulations and Standards, Building Envelope Requirements, 780 CMR sec. 1304.0 et seq., 7th Edition, Aug. 22, 2008, 11 pages, Boston, MA, United States.

Hohmann & Barnard, Product Catalog, 44 pgs (2003).

Kossecka, Ph.D, et al., Effect of Insulation and Mass Distribution in Exterior Walls on Dynamic Thermal Performance of Whole Buildings, Thermal Envelopes VII/Building Systems—Principles p. 721-731, 1998, 11 pages.

* cited by examiner

PULLOUT RESISTANT PINTLE AND ANCHORING SYSTEM UTILIZING THE SAME

BACKGROUND OF THE INVENTION

1. Field of the Invention

This invention relates to an improved anchoring arrangement for use in conjunction with cavity walls having an inner wythe and an outer wythe. More particularly, the invention relates to construction accessory devices, namely, veneer ties with configured ribbon pintles. The veneer ties are for emplacement in the outer wythe and are further accommodated by receptors in the cavity, which receptors extend from the inner wythe to capture the specially configured pintles hereof. The invention is applicable to structures having an outer wythe of brick or stone facing in combination with an inner wythe of either masonry block or dry wall construction.

2. Description of the Prior Art

In the past, investigations relating to the effects of various forces, particularly lateral forces, upon brick veneer masonry construction demonstrated the advantages of having high-strength wire anchoring components embedded in the bed joints of anchored veneer walls, such as facing brick or stone veneer. Anchor and ties are generally placed in one of the following five categories: corrugated; sheet metal; wire; two-piece adjustable; or joint reinforcing. The present invention has a focus on wire formatives and in particular, pintle ties.

Prior tests have shown that failure of anchoring systems frequently occur at the juncture between the pintle of the veneer tie and the receptor portion of the wall anchor. This invention addresses the need for a high-strength pintle suitable for use with both a masonry block and dry wall construction and provides a strong pintle-to-receptor connection.

Early in the development of high-strength anchoring systems a prior patent, namely U.S. Pat. No. 4,875,319 ('319), to Ronald P. Hohmann, in which a molded plastic clip is described as tying together reinforcing wire and a veneer tie. The assignee of '319, Hohmann & Barnard, Inc., now a MiTek-Berkshire Hathaway company, successfully commercialized the device under the SeismiClip trademark. For many years the white plastic clip tying together the veneer anchor and the reinforcement wire in the outer wythe has been a familiar item in commercial seismic-zone buildings.

Additionally, the high-strength pintle hereof has been combined with the swaged leg as shown in the inventor's patent, U.S. Pat. No. 7,325,366. The combination item reduces the number of "bits and pieces" brought to the job site and simplifies installation.

The high-strength pintle is specially configured to prevent veneer tie pullout. The configured pintle restricts movement in all directions, ensuring a high-strength connection and transfer of forces between the veneer and the backup wall.

There have been significant shifts in public sector building specifications which have resulted in architects and architectural engineers requiring larger and larger cavities in the exterior cavity walls of public buildings. These requirements are imposed without corresponding decreases in wind shear and seismic resistance levels or increases in mortar bed joint height. Thus, the wall anchors needed are restricted to occupying the same ⅜-inch bed joint height in the inner and outer wythes. Thus, the veneer facing material is tied down over a span of two or more times that which had previously been experienced. Exemplary of the public sector building specification is that of the Energy Code Requirement, Boston, Mass. (See Chapter 13 of 780 CMR, Seventh Edition). This Code sets forth insulation R-values well in excess of prior editions and evokes an engineering response opting for thicker insulation and correspondingly larger cavities.

Besides earthquake protection requiring high-strength anchoring systems, the failure of several high-rise buildings to withstand wind and other lateral forces has resulted in the promulgation of more stringent Uniform Building Code provisions. This high-strength pullout resistant pintle is a partial response thereto. The inventor's related anchoring system products have become widely accepted in the industry.

The following patents are believed to be relevant and are disclosed as being known to the inventor hereof:

| U.S. Pat. No. | Inventor | Issue Date |
|---|---|---|
| 3,377,764 | Storch | Apr. 16, 1968 |
| 4,021,990 | Schwalberg | May 10, 1977 |
| 4,373,314 | Allan | Feb. 15, 1983 |
| 4,473,984 | Lopez | Oct. 2, 1984 |
| 4,598,518 | Hohmann | Jul. 8, 1986 |
| 4,869,038 | Catani | Sep. 26, 1989 |
| 4,875,319 | Hohmann | Oct. 24, 1989 |
| 5,454,200 | Hohmann | Oct. 3, 1995 |
| 6,668,505 | Hohmann et al | Dec. 30, 2003 |
| 6,789,365 | Hohmann et al. | Sep. 14, 2004 |
| 6,851,239 | Hohmann et al. | Feb. 8, 2005 |
| 7,017,318 | Hohmann | Mar. 28, 2006 |
| 7,325,366 | Hohmann | Feb. 5, 2008 |

It is noted that these devices are generally descriptive of wire-to-wire anchors and wall ties and have various cooperative functional relationships with straight wire runs embedded in the interior and/or exterior wythe.

U.S. Pat. No. 3,377,764—D. Storch—Issued Apr. 16, 1968

Discloses a bent wire, tie-type anchor for embedment in a facing exterior wythe engaging with a loop attached to a straight wire run in a backup interior wythe.

U.S. Pat. No. 4,021,990—B. J. Schwalberg—Issued May 10, 1977

Discloses a dry wall construction system for anchoring a facing veneer to wallboard/metal stud construction with a pronged sheetmetal anchor. Like Storch '764, the wall tie is embedded in the exterior wythe and is not attached to a straight wire run.

U.S. Pat. No. 4,373,314—J. A. Allan—Issued Feb. 15, 1983

Discloses a vertical angle iron with one leg adapted for attachment to a stud; and the other having elongated slots to accommodate wall ties. Insulation is applied between projecting vertical legs of adjacent angle irons with slots being spaced away from the stud to avoid the insulation.

U.S. Pat. No. 4,473,984—Lopez—Issued Oct. 2, 1984

Discloses a curtain-wall masonry anchor system wherein a wall tie is attached to the inner wythe by a self-tapping screw to a metal stud and to the outer wythe by embedment in a corresponding bed joint. The stud is applied through a hole cut into the insulation.

U.S. Pat. No. 4,598,518—R. Hohmann—Issued Jul. 7, 1986

Discloses a dry wall construction system with wallboard attached to the face of studs which, in turn, are attached to an inner masonry wythe. Insulation is disposed between the webs of adjacent studs.

U.S. Pat. No. 4,865,038—M. J. Catani—Issued Sep. 26, 1989

Discloses a veneer wall anchor system having in the interior wythe a truss-type anchor, similar to Hala et al. '226 supra, but with horizontal sheetmetal extensions. The extensions are interlocked with bent wire pintle-type wall ties that are embedded within the exterior wythe.

U.S. Pat. No. 4,875,319—R. Hohmann—Issued Oct. 24, 1989

Discloses a seismic construction system for anchoring a facing veneer to wallboard/metal stud construction with a pronged sheetmetal anchor. Wall tie is distinguished over that of Schwalberg '990 and is clipped onto a straight wire run.

U.S. Pat. No. 5,454,200—R. Hohmann—Issued October 1995

Discloses a facing anchor with straight wire run and mounted along the exterior wythe to receive the open end of wire wall tie with each leg thereof being placed adjacent one side of reinforcement wire. As the eye wires hereof have scaled eyelets or loops and the open ends of the wall ties are sealed in the joints of the exterior wythes, a positive interengagement results.

U.S. Pat. No. 6,668,505—Hohmann et al.—Issued Dec. 30, 2003

Discloses high-span and high-strength anchors and reinforcement devices for cavity walls combined with interlocking veneer ties are described which utilize reinforcing wire and wire formatives to form facing anchors, truss or ladder reinforcements, and wall anchors providing wire-to-wire connections therebetween.

U.S. Pat. No. 6,789,365—R. Hohmann et al.—Issued Sep. 14, 2004

Discloses side-welded anchor and reinforcement devices for a cavity wall. The devices are combined with interlocking veneer anchors, and with reinforcements to form unique anchoring systems. The components of each system are structured from reinforcing wire and wire formatives.

U.S. Pat. No. 6,851,239—Hohmann et al.—Issued Feb. 8, 2005

Discloses a high-span anchoring system described for a cavity wall incorporating a wall reinforcement combined with a wall tie which together serve a wall construct having a larger-than-normal cavity. Further the various embodiments combine wire formatives which are compressively reduced in height by the cold-working thereof. Among the embodiments is a veneer anchoring system with a low-profile wall tie for use in a heavily insulated wall.

U.S. Pat. No. 7,017,318—Hohmann—Issued Mar. 28, 2006

Discloses an anchoring system with low-profile wall ties in which insertion portions of the wall anchor and the veneer anchor are compressively reduced in height.

U.S. Pat. No. 7,325,366—Hohmann—Issued Feb. 5, 2008

Discloses snap-in veneer ties for a seismic construction system in cooperation with low-profile, high-span wall anchors.

None of the above anchors or anchoring systems provide a veneer tie having a high-strength pullout resistant pintle for fulfilling the need for enhanced compressive and tensile properties. This invention relates to an improved anchoring arrangement for use in conjunction with cavity walls having an inner wythe and an outer wythe and meets the heretofore unmet need described above.

SUMMARY

In general terms, the invention disclosed hereby is a high-strength pullout resistant pintle and an anchoring system utilizing the same for cavity walls having an inner and outer wythe. The system includes a wire-formative veneer tie for emplacement in the outer wythe. The high-strength construction system hereof is applicable to construction of a wall having an inner wythe which can either be of dry wall construction or masonry block and an outer wythe and to insulated and non-insulated structures. The wythes are in a spaced apart relationship and form a cavity therebetween. In the disclosed system, a unique combination of a wall anchor (attachable to either ladder- or truss-type reinforcement for masonry inner wythes or to metal studs of a dry wall construct), a wire veneer tie, and, optionally, a continuous wire reinforcement is provided. The invention contemplates that the veneer ties are wire formatives with high-strength ribbon pintles with securement portions depending into the wall cavity for connections between the veneer tie and the wall anchor.

In the first embodiment of this invention, the veneer tie is constructed from a wire formative and has configured ribbon pintles that provide a high strength connection, restricting vertical, lateral and horizontal movement when interconnected with a wall anchor and embedded in the bed joint of the outer wythe.

In the second embodiment, the veneer tie is engaged with a wall anchor that is interconnected with a ladder- or truss-type reinforcement in a manner similar to the wall anchor shown in Hohmann, U.S. Pat. No. 6,789,365. The anchor eye wires there extend into the cavity between the wythes. Each pair of eye wires accommodates the interengagement therewith of the high-strength pintles of the veneer ties. The veneer tie is positioned so that the insertion end thereof is embedded in the bed joint of the outer wythe. The construction of the veneer tie results in an orientation upon emplacement so that the widest part of the pintle is subjected to compressive and tensile forces. As the eye wires have sealed eyelets or loops with predetermined dimensions the horizontal movement of the construct is restricted accordingly.

The second embodiment further includes a dry wall construct inner wythe. Here, the dry-wall anchor is a metal stamping and is attached by sheetmetal screws to the metal vertical channel members of the wall. Each dry-wall anchor accommodates in a horizontally extending portion, the high-strength ribbon pintles of the wire formative veneer tie. The securement portion of the ribbon pintles prevents veneer tie pullout. In this embodiment the insertion end of the veneer tie is then optionally positioned on the outer wythe so that a continuous reinforcement wire can be snapped into and is secured to the outer wythe anchor. The snap-in feature of the anchor here replaces the traditional function of the seismic clip for accommodating a straight wire run (see U.S. Pat. No. 4,875,319) and receiving the open end of the box tie. This anchor and a straight wire run are embedded in the bed joint of the outer wythe.

It is an object of the present invention to provide in an anchoring system having an outer wythe and an inner wythe, a high-strength pullout resistant veneer tie that interengages a wall anchor which system further includes specially configured ribbon pintles in the veneer tie.

It is another object of the present invention to provide labor-saving devices to simplify seismic and nonseismic high-strength installations of brick and stone veneer and the securement thereof to an inner wythe.

It is yet another object of the present invention to provide a cold worked wire formative that is characterized by high resistance to compressive and tensile forces.

It is a further object of the present invention to provide an anchoring system for cavity walls comprising a limited number of component parts that are economical of manufacture resulting in a relatively low unit cost.

It is yet another object of the present invention to provide an anchoring system which restricts lateral, vertical and horizontal movements of the facing wythe with respect to the inner wythe but remains adjustable vertically.

It is a feature of the present invention that the veneer tie, after being inserted into the receptors therefor, the pintles are oriented so that the widest portion thereof is subjected to compressive to tensile forces.

It is another feature of the present invention that the veneer ties are utilizable with either a masonry block having aligned or unaligned bed joints or for a dry wall construct that secures to a metal stud.

Other objects and features of the invention will become apparent upon review of the drawings and the detailed description.

BRIEF DESCRIPTION OF THE DRAWINGS

In the following drawings, the same parts in the various views are afforded the same reference designators.

DESCRIPTION OF THE PREFERRED EMBODIMENTS

Figure 1:
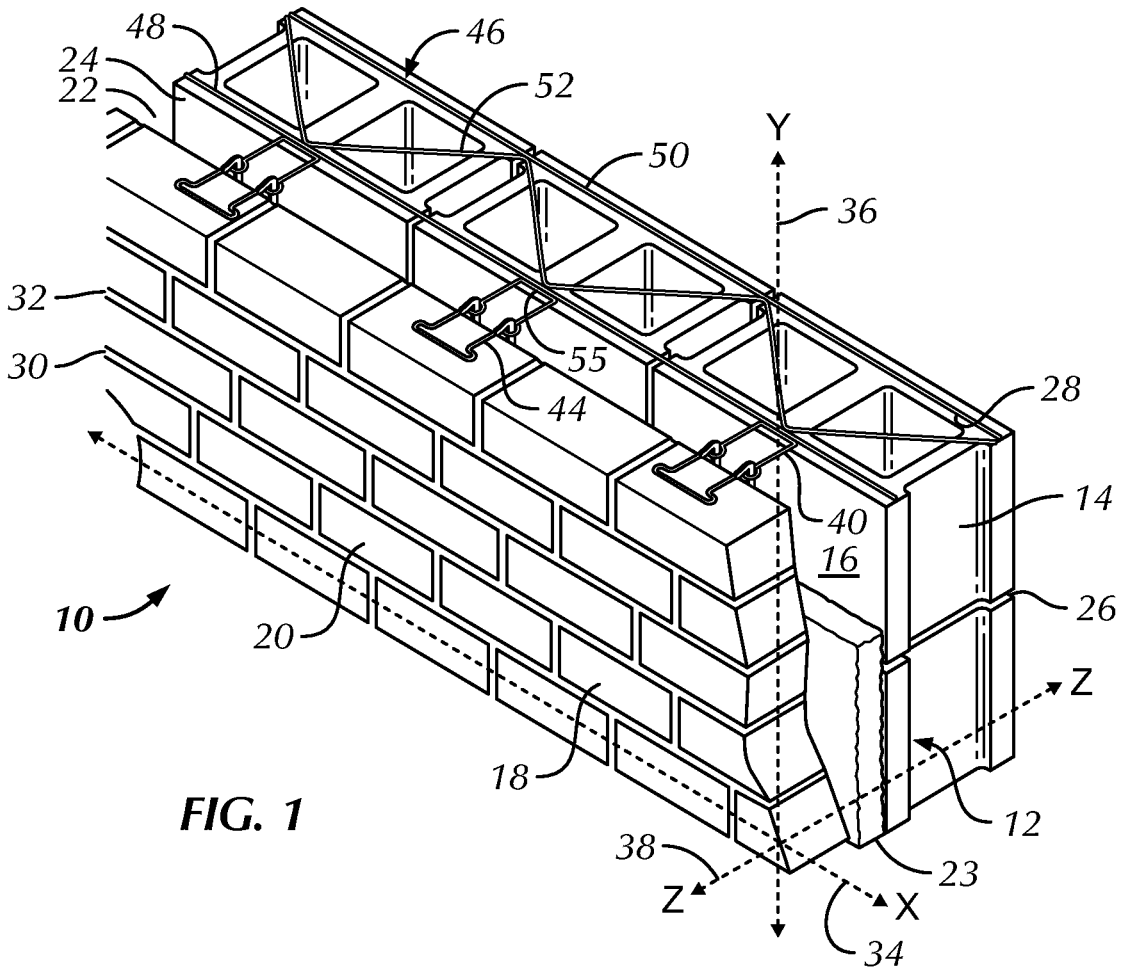
FIG. 1 is a perspective view of an anchoring system having a veneer tie with high-strength ribbon pintles of this invention and side-welded wall anchor and shows a wall with an inner wythe of masonry block and an outer wythe of brick veneer.

In the embodiments described herein the pintles of the wire components of the veneer ties are cold-worked or otherwise partially flattened and specially configured resulting in greater tensile and compressive strength and thereby becoming better suited to cavity walls wherein high wind loads or seismic forces are experienced. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween. The deformed body has substantially the same cross-sectional area as the original wire. Here, the circular cross-section of a wire provides greater flexural strength than a sheetmetal counterpart.

Before proceeding to the detailed description, the following definitions are provided. For purposes of defining the invention at hand, a ribbon pintle is a wire formative that has been compressed by cold working so that the resultant body is substantially semicircular at the edges and has flat surfaces therebetween. In use the rounded edges are aligned so as to receive compressive forces transmitted from the veneer or outer wythe, which forces are generally normal to the facial plane thereof. In the discussion that follows the width of the ribbon pintle is also referred to as the major axis and the thickness is referred to as the minor axis.

As the compressive forces are exerted on the ribbon edges, the ribbon pintles withstand forces greater than uncompressed pintles formed from the same gage wire. Data reflecting the enhancement represented by the cold-worked ribbon pintles is included hereinbelow.

The description which follows is of two embodiments of anchoring systems utilizing the high-strength pintle veneer tie devices of this invention, which devices are suitable for nonseismic and seismic cavity wall applications. Although each high-strength veneer tie is adaptable to varied inner wythe structures, the embodiments here apply to cavity walls with masonry block inner wythes, and to a cavity wall with a dry wall (sheetrock) inner wythe. The wall anchor of the first embodiment is adapted from that shown in U.S. Pat. No. 6,789,365 of the inventors hereof. For the masonry structures, mortar bed joint thickness is at least twice the thickness of the embedded anchor.

In accordance, with the *Building Code Requirements for Masonry Structures, ACI* 530-05/*ASCE* 5-05/*TMS* 402-05, each wythe of the cavity wall structure is designed to resist individually the effects of the loads imposed thereupon. Further, the veneer (outer wythe) is designed and detailed to accommodate differential movement and to distribute all external applied loads through the veneer to the inner wythe utilizing masonry anchors and ties.

Referring now to FIGS. 1 through 8 and 11, the first embodiment of the anchoring system hereof including a high-strength pullout resistant veneer tie of this invention is shown and is referred to generally by the number 10. In this embodiment, a wall structure 12 is shown having a backup wall or inner wythe 14 of masonry blocks 16 and a veneer facing or outer wythe 18 of facing brick or stone 20. Between the backup wall 14 and the facing wall 18, a cavity 22 is formed, which cavity 22 extends outwardly from the surface 24 of the backup wall 14. Optionally, the cavity is filled with insulation 23.

In this embodiment, successive bed joints 26 and 28 are formed between courses of blocks 16 and the joints are substantially planar and horizontally disposed. Also, successive bed joints 30 and 32 are formed between courses of facing brick 20 and the joints are substantially planar and horizontally disposed. For each structure, the bed joints 26, 28, 30 and 32 are specified as to the height or thickness of the mortar layer and such thickness specification is rigorously adhered to so as to provide the uniformity inherent in quality construction. Selected bed joint 26 and bed joint 30 are constructed to align, that is to be substantially coplanar, the one with the other.

For purposes of discussion, the exterior surface 24 of the backup wall 14 contains a horizontal line or x-axis 34 and an intersecting vertical line or y-axis 36. A horizontal line or z-axis 38, normal to the xy-plane, also passes through the coordinate origin formed by the intersecting x- and y-axes. In the discussion which follows, it will be seen that the various anchor structures are constructed to restrict movement interfacially—wythe vs. wythe—along the z-axis and, in this embodiment, along the x-axis. The device 10 includes a wall anchor 40 constructed for embedment in bed joint 26, which, in turn, includes a free end 42 with one or more legs or receptor portions 54 extending into cavity 22. Further, the device 10 includes a wire formative veneer tie or anchor 44 for embedment in bed joint 30.

Figure 2:
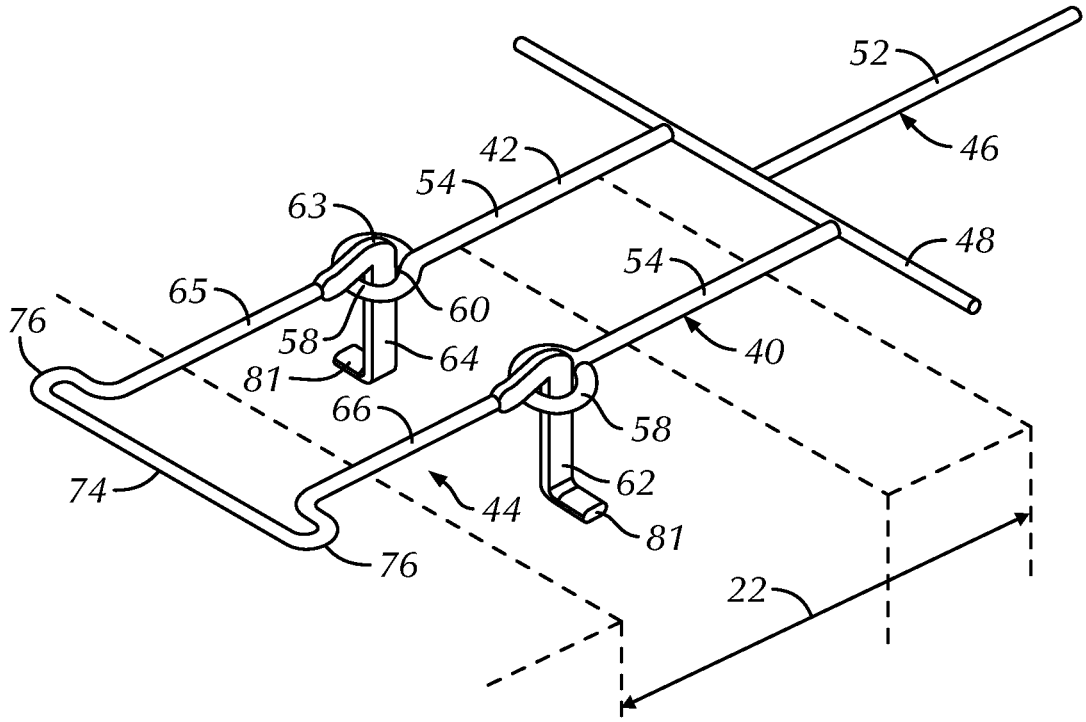
FIG. 2 is a perspective view of the veneer tie of FIG. 1 showing details of the veneer tie with high-strength pintles secured within a ladder reinforcement anchoring system.
Figure 3:
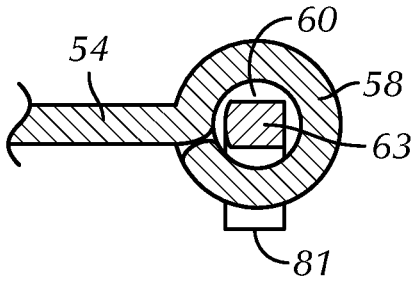
FIG. 3 is a partial cross-sectional view of the anchoring system of FIG. 1 on a substantially horizontal plane showing the receptor portion of the wall anchor and the pintle of the veneer tie.
Figure 4:
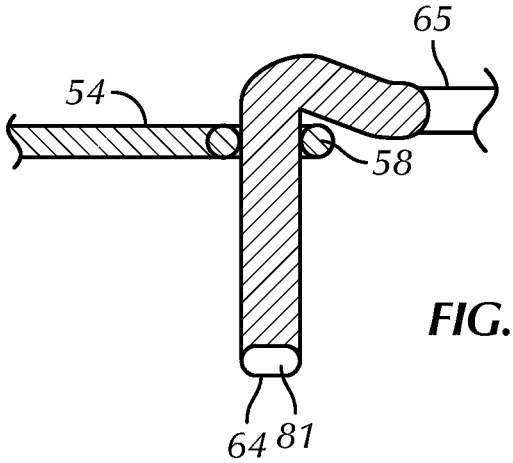
FIG. 4 is a partial cross-sectional view of the anchoring system of FIG. 1 on a substantially vertical plane showing the receptor portion of the wall anchor and the pintle of the veneer tie.
Figure 5:
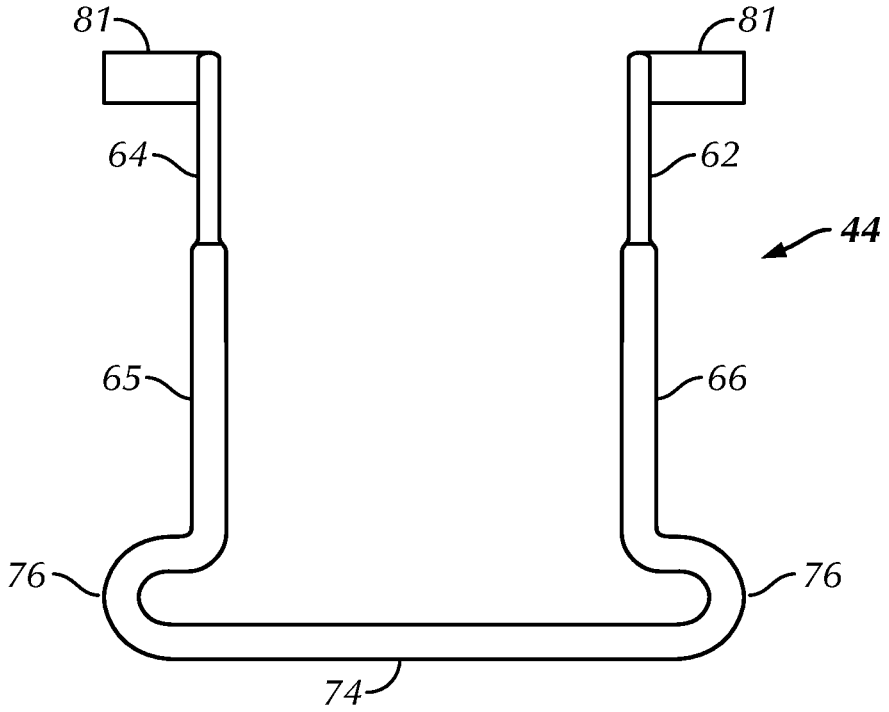
FIG. 5 is a top plan view of the veneer tie of FIG. 1.
Figure 6:
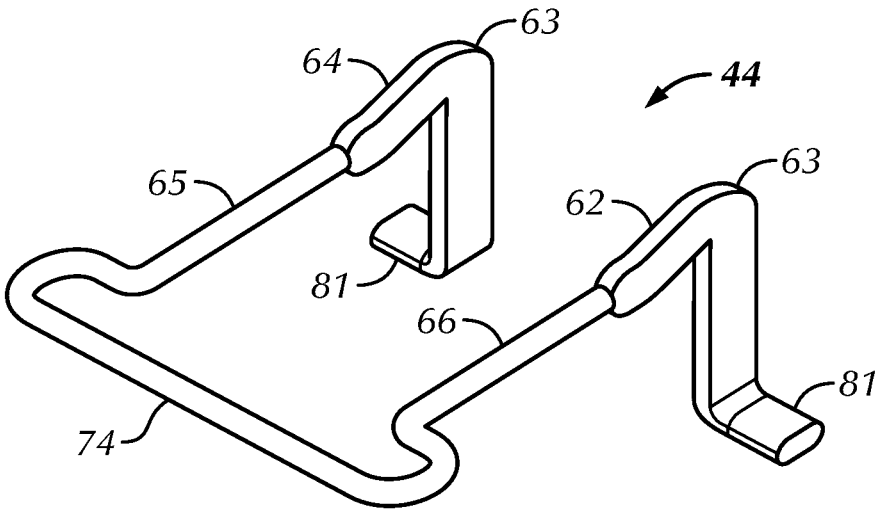
FIG. 6 is a perspective view of the veneer tie of FIG. 1.
Figure 7:
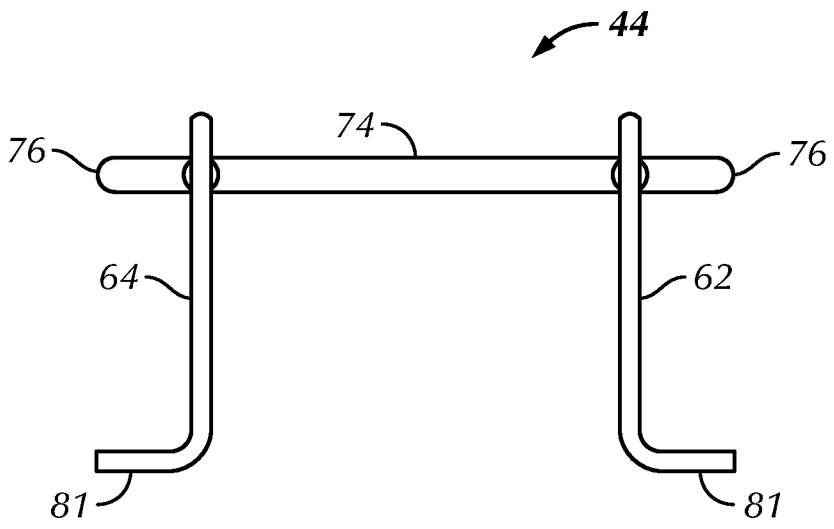
FIG. 7 is a rear view of the veneer tie of FIG. 1.
Figure 8:
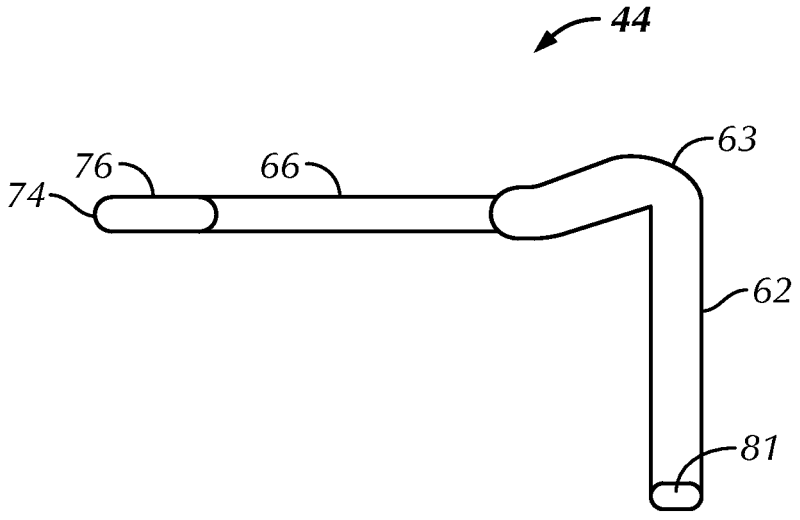
FIG. 8 is a side view of the veneer tie of FIG. 1.

The wall anchor 40 is shown in FIGS. 1 and 2 as being emplaced on a course of blocks 16 in preparation for embedment in the mortar of bed joint 26. In the best mode of practicing this embodiment, a truss-type wall reinforcement wire portion 46 is constructed of a wire formative with two parallel continuous straight wire members 48 and 50 spaced so as, upon installation, to each be centered along the outer walls of the masonry blocks 16. Intermediate wire bodies or cross rods 52 are interposed therebetween and connect wire members 48 and 50 forming truss-like portions of the reinforcement structure 46. Alternatively, the cross rods are formed in a ladder shaped manner as shown in FIG. 2.

At intervals along the wall reinforcement 46, spaced pairs of transverse wire members or receptor portions 54 are attached thereto at wire member 48. Alternatively, as shown in FIG. 1, the legs 54 are connected with a rear leg 55 and the rear leg 55 is, in turn, attached to the wall reinforcement 46. The free end 42 and the receptor portions 54 extend into cavity 22 to the veneer tie 44. As will become clear by the description which follows, the spacing between the receptor portions 54 is constructed to limit the x-axis movement of the construct. Each receptor portion 54 has at the end opposite the attachment end an eyelet 58 formed contiguously therewith. The eyelet 58 is preferably welded closed, and has a substantially circular opening or elongated oval eye 60.

Upon installation, the eye or aperture 60 of eyelet 58 is constructed to be within a substantially horizontal plane normal to exterior surface 24. The aperture 60 is dimensioned to accept an interconnecting portion or ribbon pintle of the veneer tie or anchor 44 therethrough and has a slightly larger opening than that required to accommodate the pintle and insertion of the securement portion 81. The eyelet 58 and aperture 60 are constructed to accept the swinging insertion of the veneer tie 44. This relationship minimizes the movement of the construct in along a z-vector and in an xz-plane. For positive engagement, the aperture 60 of eyelet 58 is sealed, through welding or similar method, forming a closed loop.

The veneer tie 44 is more fully shown in FIGS. 2 and 5 through 8. The veneer tie 44, when viewed from a top or bottom elevation, is a modified U-shaped design and is dimensioned to be accommodated by the pair of eyelets 58 previously described. The tie 44 is constructed from mill galvanized, hot-dip galvanized, stainless steel or other similar high-strength material and has an insertion portion 74 comprising two contiguous hook portions 76 for disposition in the bed joint 30, two ribbon pintles 62, 64, each forming an interengaging portion 63 and a securement portion 81 for disposition in the receptors 58, and two cavity portions 65, 66 that engage the anchor 40 by connecting the insertion portion 74 and the interengaging portion 63. The insertion portion 74 is configured to maximize surface contact with the mortar in the bed joint 30. The insertion portion 74 has two hooks 76 that extend from the cavity portions 65, 66 and are contiguous and interconnected. The interengaging portion 63 is rounded at a substantially 90 degree angle and contiguous with the securement portion 81 which is disposed at a substantially 90 degree angle from the interengaging portion 63. The ribbon pintles 62, 64 are dimensioned to be received within the receptor portions 54 through compression or by swinging the veneer tie 44 into the receptor portions 54. The securement portion 81 is dimensioned to be greater than the diameter of each opening of the receptor portion 54. Once secured within the receptor portions 54, the veneer tie 44 restricts lateral, vertical and horizontal movement.

The veneer tie 44 is a wire formative and has compressively reduced ribbon pintles 62, 64 formed by compressively reducing the interengaging portion 63 of the veneer tie 44. Each ribbon pintle 62, 64 is dimensioned to closely fit one of the receptor portion 54 openings 58. As more clearly seen in FIGS. 3 and 4, the ribbon pintles 62, 64 have been compressively reduced so that, when viewed as installed, the cross-section taking in a horizontal or an xz-plane that includes the longitudinal axis of the receptor 58 shows the greatest dimension substantially oriented along a z-vector. Similarly, when viewed as installed, the cross-section taking in a vertical plane that includes the longitudinal axis of the wire member 54 shows the major axis dimension substantially oriented along a z-vector.

Figure 10:
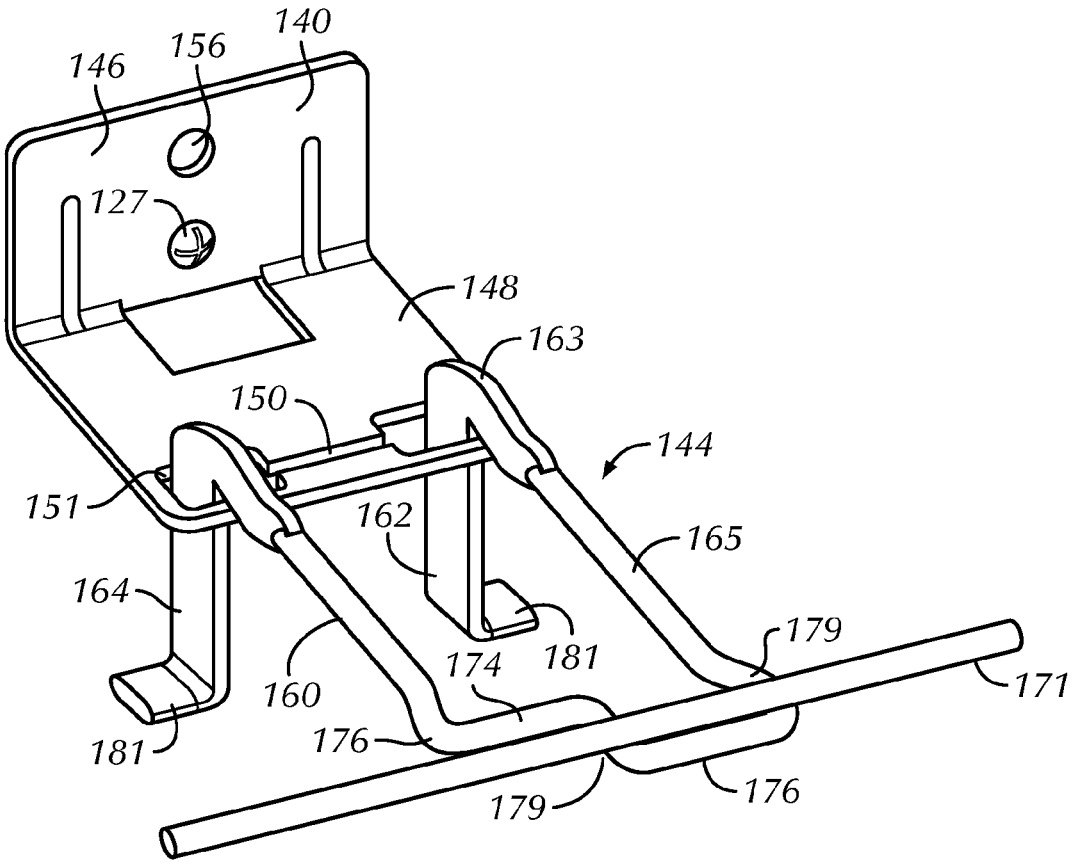
FIG. 10 is a perspective view of a sheet metal anchoring system of this invention having a veneer tie interengaged with a sheetmetal wall anchor for mounting on a drywall inner wythe and an outer wythe of brick veneer and a reinforcement wire set within a modified veneer tie.

The insertion portion 74 is optionally configured (as shown in FIG. 10) to accommodate therewithin a reinforcement wire or straight wire member 171 of predetermined diameter. The insertion portion 174 twists around the reinforcement wire 171 to clamp the wire 171 into place using housings containing clamping jaws 179 which are spaced to require an insertion force from 5 to 10 lbs. With this configuration, the bed joint height specification is readily maintained.

The cross-sectional illustrations show the manner in which wythe-to-wythe and side-to-side movement is limited by the close fitting relationship between the compressively reduced pintles and the receptor openings. The minor axis of the compressively reduced pintle 62 is optimally between 30 to 75% of the diameter of the 0.172- to 0.312 inch wire formative and when reduced by one-third has a tension and compression rating of at least 130% of the original wire formative material. The pintle, once compressed, is ribbon-like in appearance; however, maintains substantially the same cross sectional area as the wire formative body.

The description which follows is of a second embodiment of the high-strength pintle anchoring system. For ease of comprehension, where similar parts are used reference designators "100" units higher are employed. Thus, the veneer tie 144 of the second embodiment is analogous to the veneer tie 44 of the first embodiment.

Figure 9:
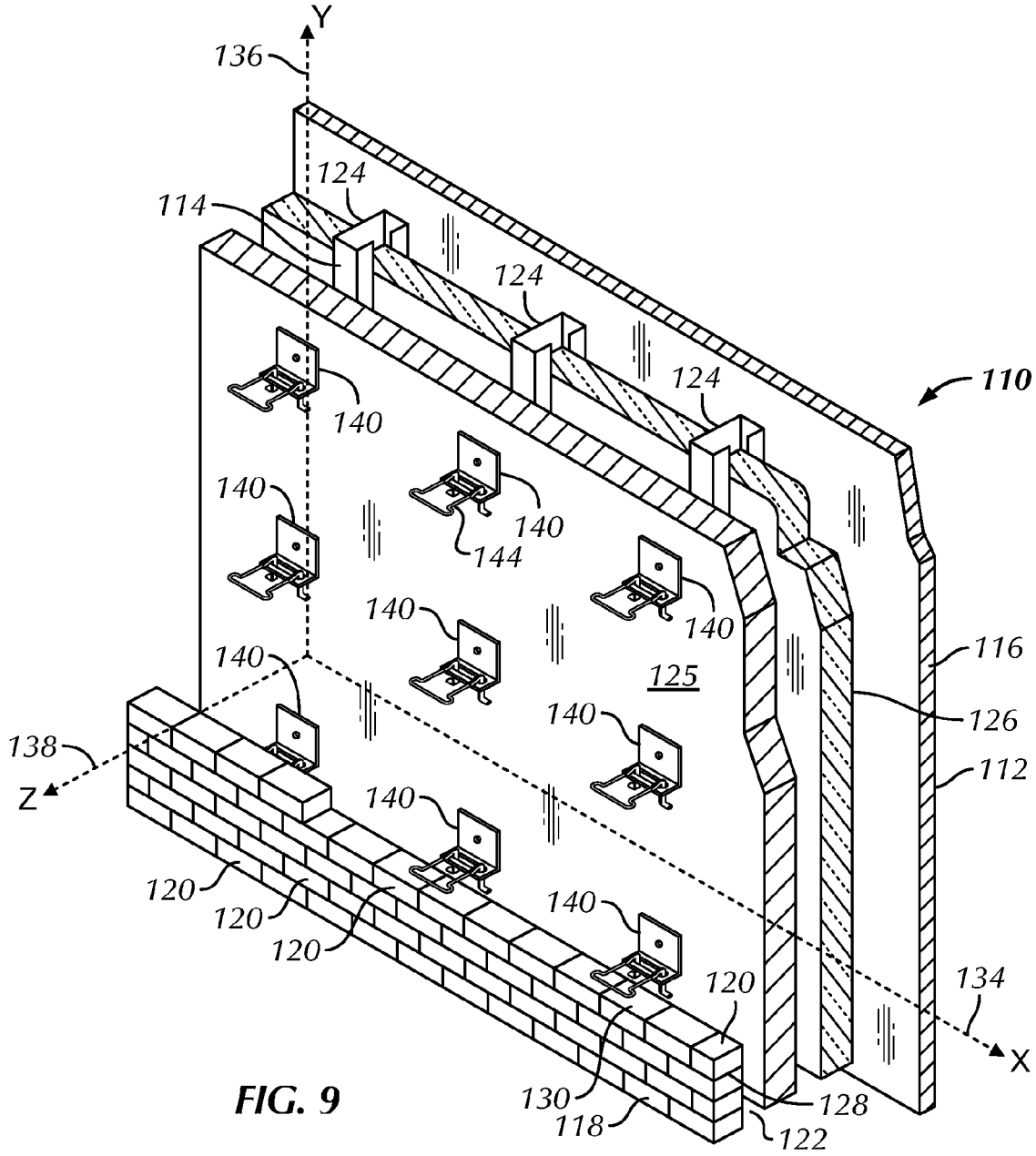
FIG. 9 is a perspective view of an anchoring system of this invention having a veneer tie with high-strength pullout resistant ribbon pintles of this invention, wherein the building system therefor includes a sheetmetal anchor for a drywall inner wythe.
Figure 11:
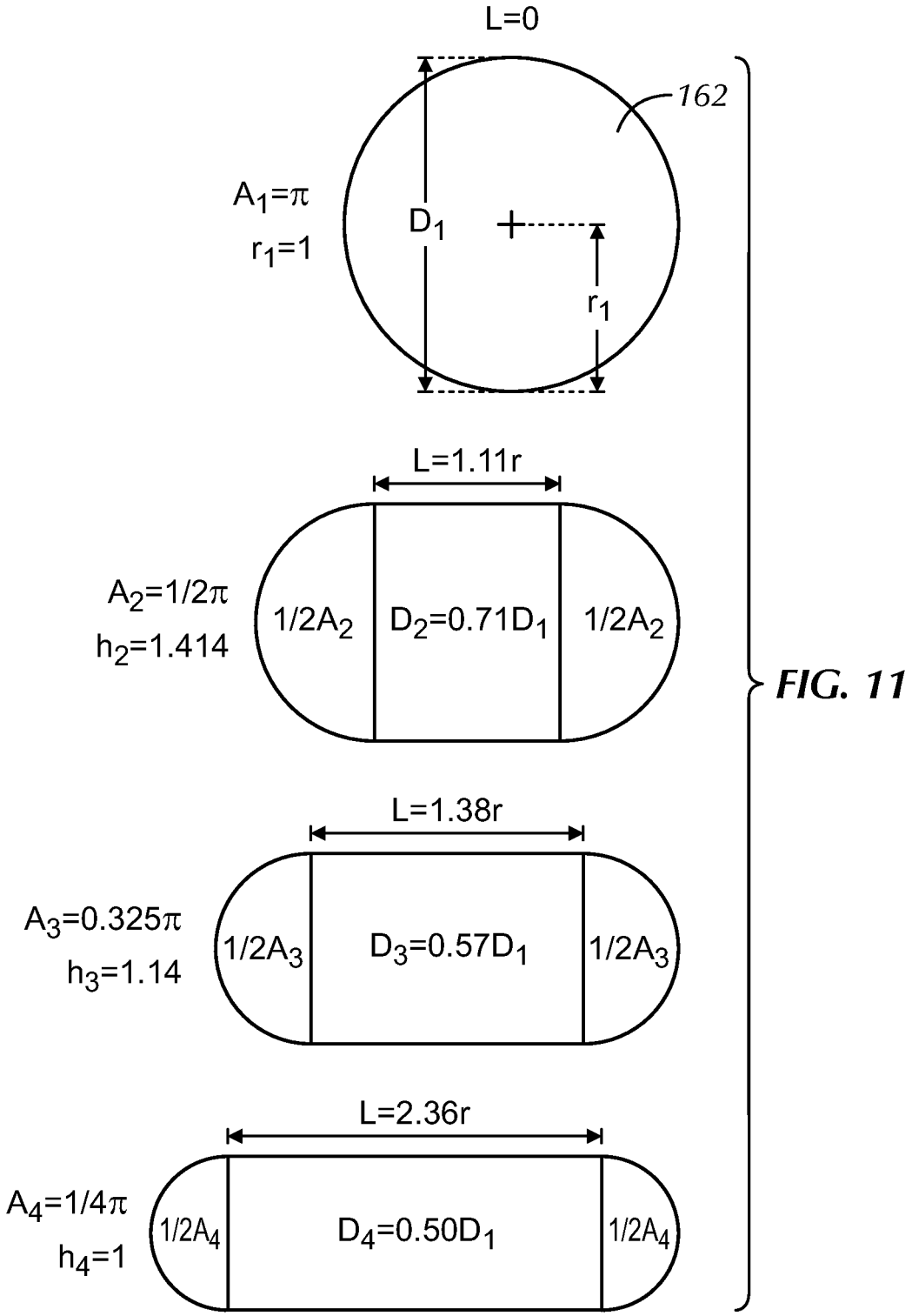
FIG. 11 is a cross-sectional view of cold-worked wire used in the formation of the ribbon pintles hereof and showing resultant aspects of continued compression.

Referring now to FIGS. 9 through 11, the second embodiment of the high-strength pintle anchoring system is shown and is referred to generally by the numeral 110. The system 110 employs a sheetmetal wall anchor 140. The dry wall structure 112 is shown having an interior wythe 114 with wallboard 116 as the interior and exterior facings thereof. An exterior or outer wythe 118 of facing brick 120 is attached to dry wall structure 112 and a cavity 122 is formed therebetween. The dry wall structure 112 is constructed to include, besides the wallboard facings 116, vertical channels 124 with insulation layers 126 disposed between adjacent channel members 124. Selected bed joints 128 and 130 are constructed to be in cooperative functional relationship with the veneer tie described in more detail below.

For purposes of discussion, the exterior surface 125 of the interior wythe 114 contains a horizontal line or x-axis 134 and an intersecting vertical line or y-axis 136. A horizontal line or z-axis 138 also passes through the coordinate origin formed by the intersecting x- and y-axes. The system 110 includes a dry wall anchor 140 constructed for attachment to vertical channel members 124, for embedment in joint 130 and for interconnecting with the veneer tie 144.

Reference is now directed to the L-shaped, surface-mounted sheetmetal bracket or wall anchor 140 comprising a mounting portion or base plate member 146 and free end projecting or extending portion 148 into the cavity 122 with a pintle-receiving portion. The projecting or extending portion 148 is contiguous with the base plate member 146 so as to have, upon installation, a horizontally disposed elongated aperture 150 which, as best seen in FIG. 10, provides for wire-tie-receiving receptors 151. The aperture 150 is formed in plate member 148. Upon installation, the projecting portion 148 is thus disposed substantially at right angles with respect to the plate member 146. To ease tolerance receptors 151 may be slightly elongated along the x-axis thereof. The plate member 146 is also provided with mounting holes 156 at the upper and lower ends thereof.

As is best seen in FIG. 10, the projecting portion 148 is spaced from the plate member 146 and adapted to receive the pintles 162, 164 of veneer tie 144 therewithin. In the fabrication of the dry wall as the inner wythe of this construction system 110, the channel members 124 are initially secured in place. In this regard, the channel members 124 may also comprise the standard framing member of a building. Sheets of exterior wallboard 116, which may be of an exterior grade gypsum board, are positioned in abutting relationship with the forward flange of the channel member 124. While the insulating layer 126 is shown as panels dimensioned for use between adjacent column 124, it is to be noted that any similarly suited rigid of flexible insulating material may be used herein with substantially equal efficacy.

After the initial placement of the flexible insulation layer 126 and the wallboard 116, the veneer anchors 140 are secured to the surface of the wallboard 116 in front of channel members 124. Thereafter, sheetmetal screws 127 are inserted into the mounting holes 156 to fasten the anchor 140 to the channel member 124.

The veneer tie 144 when viewed from a top or bottom elevation, is a modified U-shaped design and is dimensioned to be accommodated by the receptor 151 previously described. The tie 144 has an insertion portion 174 with two contiguous hook portions 176 for disposition in the bed joint 130, one or more ribbon pintles 162, 164, each forming an interengaging portion 163 and a securement portion 181 for disposition in the receptors 150, two cavity portions 165, 160 that engages the anchor 140 by connecting the insertion portion 174 and the interengaging portion 163. The insertion portion 174 is configured to maximize surface contact with the mortar in the bed joint 130. The tie 144 is constructed from mill galvanized, hot-dip galvanized, stainless steel or other similar high-strength material. The interengaging portion 163 is rounded at a substantially 90 degree angle and contiguous with the securement portion 181 which is disposed at a substantially 90 degree angle from the interengaging portion 163. The ribbon pintles 162, 164 are dimensioned to be received within the receptor 151 through compression or by swinging the veneer tie 144 into the receptor 151. The distance between the securement portions 181 is dimensioned to be greater than the diameter of the receptor 151. Once secured within the receptor 151, the veneer tie 144 restricts lateral, vertical and horizontal movement.

The veneer tie 144 is a wire formative and has compressively reduced ribbon pintles 162, 164 formed by compressively reducing the interengaging portion 163 of the veneer tie 144. Each ribbon pintle 162, 164 is dimensioned to closely fit within the receptor 151. The ribbon pintles 162, 164 have been compressively reduced so that, when viewed as installed, the cross-section taking in a horizontal or an xz-plane that includes the longitudinal axis of the receptor shows the greatest dimension substantially oriented along a z-vector. The minor axis of the compressively reduced pintle 162 is optimally between 30 to 75% of the diameter of the receptor 150 and results in a veneer tie having compressive/tensile strength 130% of the original 0.172- to 0.312-inch wire formative material. The pintle, once compressed, is ribbon-like in appearance; however, maintains substantially the same cross sectional area as the wire formative body.

The ribbon pintles 162 and 164 of veneer tie 144 are considerably compressed and while maintaining the same mass of material per linear unit as the adjacent wire formative, a thick ribbon is produced. The resultant width or major axis of the ribbon pintles 162 and 164 are increased so that, upon installation, the widths are dimensioned to have a close fitting relationship with receptor 151. The cold working enhances the mounting strength of veneer tie 144 and resist force vectors along the z-axis 138. The insertion portion of the veneer tie is considerably compressed with the vertical height being reduced. The insertion portion of the veneer tie has been strengthened in several ways. First, in place of the standard 9-gage (0.148-inch diameter) wall reinforcement wire, a 0.172- to 0.312-inch (0.187-inch diameter) wire is used. As a general rule, compressive reductions up to 75% are utilized and calculations are based thereon.

The insertion portion 174 is optionally configured to accommodate therewithin a reinforcement wire or straight wire member 171 of predetermined diameter. The insertion portion 174 twists around the reinforcement wire 171 to clamp the wire 171 into place using housings with clamping jaws 179 which are spaced to require an insertion force from 5 to 10 lbs. With this configuration the bed joint height specification is readily maintained. As differentiated from the first two embodiments, the dry wall construction system 110 provides for the structural integrity by the securement of the veneer anchor construction to the channel member. The anchoring system hereof meets building code requirements for seismic construction and the wall structure reinforcement of both the inner and outer wythes exceeds the testing standards therefor.

In FIG. 11, the compression of wire formatives is shown schematically. For purposes of discussion, the elongation of the compressed wire is disregarded as the elongation is negligible and the cross-sectional area of the construct remains substantially constant. Here, the veneer tie 144 is formed from 0.172- to 0.312-inch diameter wire and the ribbon pintles 162, 164 are reduced up to 75% of original diameter to a thickness of 0.113- to 0.187-inches.

Analytically, the circular cross-section of a wire provides greater flexural strength than a sheetmetal counterpart. In the embodiments described herein the ribbon pintles components of the veneer tie 144 is cold-worked or partially flattened so that the specification is maintained and high-strength ribbon pintles are provided. It has been found that, when the appropriate metal alloy is cold-worked, the desired plastic deformation takes place with a concomitant increase in tensile strength and a decrease in ductility. These property changes suit the application at hand. In deforming a wire with a circular cross-section, the cross-section of the resultant body is substantially semicircular at the outer edges with a rectangular body therebetween, FIG. 11. The deformed body has substantially the same cross-sectional area as the original wire. In each example in FIG. 11, progressive deformation of a wire is shown. Disregarding elongation and noting the prior comments, the topmost portion shows the original wire having a radius, $r_1=1$; and area, $A_1=\Pi$; length of deformation, L=0; and a diameter, $D_1$. Upon successive deformations, the illustrations shows the area of circular cross-section bring progressively ½, ⅜ and ¼ of the area, $A_1$, or $A_2$=½Π; $A_3$=⅜Π; and $A_4$=¼Π, respectively. With the first deformation, the rectangular portion has a length L=1.11r (in terms of the initial radius of 1); a height, $h_2$=1.14; ($D_2$=0.71$D_1$, where D=diameter); and therefore has an area of approximately ½Π. Likewise, with the second deformation, the rectangular portion has a length, L=1.38r; a height, $h_3$=1.14; a diameter $D_3$=0.57$D_1$; and therefore has an area of approximately ⅝Π. Yet again, with the third deformation, the rectangular portion has a length, L=2.36r; a height $h_4$=1; a diameter, degree of plastic deformation to remain at a 0.300 inch (approx.) combined height for the truss and wall tie can, as will be seen hereinbelow, be used to optimize the high-strength ribbon pintle anchoring system.

In testing the high-strength veneer tie described hereinabove, the test protocol is drawn from ASTM Standard E754-80 (Reapproved 2006) entitled, *Standard Test Method for Pullout Resistance of Ties and Anchors Embedded in Masonry Mortar Joints*. This test method is promulgated by and is under the jurisdiction of ASTM Committee E06 on Performance of Buildings and provides procedures for determining the ability of individual masonry ties and anchors to resist extraction from a masonry mortar joint.

In forming the ribbon pintles, the wire body of up to 0.375-inch in diameter is compressed up to 75% of the wire diameter. When compared to standard, wire formatives having diameters in the 0.172- to 0.195-inch range, a ribbon pintle reduced by one-third from the same stock as the standard tie showed upon testing a tension and compression rating that was at least 130% of the rating for the standard tie.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed is:

1. A high-strength pintle veneer tie for use with an anchoring system in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said veneer tie comprising:

an insertion portion for disposition in said bed joint of said outer wythe, said insertion portion comprising two contiguous hook portions;

two cavity portions contiguous with said hook portions; and, two ribbon pintles contiguous with said cavity portions and set opposite said hook portions, wherein said ribbon pintles are compressively reduced, each of said ribbon pintles having a thickness and a width greater than the thickness, the width being substantially parallel to the cavity portions, said ribbon pintles each further comprising:

an interengaging portion for disposition within said anchoring system, said interengaging portion rounded at a substantially 90 degree angle; and, a securement portion contiguous with said interengaging portion opposite said cavity portion, said securement portion disposed at a substantially 90 degree angle from said interengaging portion;

whereby upon insertion within said anchoring system, said veneer tie restricts lateral, vertical and horizontal movement.

2. A high-strength pintle veneer tie as described in claim 1 wherein said ribbon pintles are compressively reduced in thickness by up to 75% of an original diameter thereof.

3. A high-strength pintle anchoring system as described in claim 2, wherein said ribbon pintles are fabricated from 0.172- to 0.312-inch diameter wire and when reduced by one-third have a tension and compression rating at least 130% of the rating for a non-reduced pintle.

4. A high-strength pintle veneer tie as described in claim 2 wherein said insertion portion is fabricated from 0.172- to 0.312-inch diameter wire and wherein said wire formative is compressively reduced to a height of between 0.162 to 0.187 inches.

5. A high-strength pintle veneer tie as described in claim 4 wherein said veneer tie insertion portion further comprises one or more housings each having a clamping jaw for receiving a reinforcement wire whereby, upon installation of said veneer tie in said anchoring system with said reinforcing wire in said outer wythe, said system provides a high degree of seismic protection.

6. A high-strength pintle anchoring system for use in a wall having an inner wythe and an outer wythe in a spaced apart relationship the one with the other and having a cavity therebetween, said outer wythe formed from a plurality of courses with a bed joint of predetermined height between each two adjacent courses, said bed joint being filled with mortar, said system comprising:

a wall anchor for fixedly attaching to said inner wythe so that a free end thereof extends into said cavity, said free end of said wall anchor comprising:

one or more receptor portions for disposing in said cavity, said one or more receptor portions being openings adapted to be disposed substantially horizontal in said cavity; and, a wire-formative veneer tie comprising:

an insertion portion for disposition in said bed joint of said outer wythe, said insertion portion comprising two contiguous hook portions;

two cavity portions contiguous with said hook portions; and, two ribbon pintles contiguous with said cavity portions and set opposite said hook portions, wherein said ribbon pintles are compressively reduced, each of said ribbon pintles having a thickness and a width greater than the thickness, the width being substantially parallel to the cavity portions, said ribbon pintles each further comprising:

an interengaging portion for disposition within said anchoring system, said interengaging portion rounded at a substantially 90 degree angle; and, a securement portion contiguous with said interengaging portion opposite said cavity portion, said securement portion disposed at a substantially 90 degree angle from said interengaging portion;

whereby upon insertion within said anchoring system, said veneer tie restricts lateral, vertical and horizontal movement.

7. A high-strength pintle anchoring system as described in claim 6 wherein said one or more receptor portions further comprise two eyelets spaced apart at a predetermined interval and disposed substantially horizontally in said cavity.

8. A high-strength pintle anchoring system as described in claim 7 wherein each of said ribbon pintles is dimensioned to closely fit one of said openings of said one or more receptor portions; and, wherein each of said two eyelets is welded closed and has a substantially circular opening therethrough with a predetermined diameter.

9. A high-strength pintle anchoring system as described in claim 8 wherein said inner wythe is formed from successive courses of masonry block with a bed joint of predetermined height between each two adjacent courses and having a reinforcement ladder or truss in said bed joint, said wall anchor further comprising:

a wire formative fixedly attached to said reinforcement having at least two legs extending into and terminating within said cavity.

10. A high-strength pintle anchoring system as described in claim 9 wherein the length of each said securement portion is dimensioned to be greater than the diameter of each said opening of said one or more receptor portions.

11. A high-strength pintle anchoring system as described in claim 10 wherein a width of said ribbon pintles is in a close fitting functional relationship with said diameter of said eyelet.

12. A high-strength pintle anchoring system as described in claim 11 wherein the widths of said ribbon pintles are substantially parallel to the longitudinal axes of said legs of said wall anchor; and, wherein said ribbon pintles are compressively reduced in thickness up to 75% of an original diameter thereof.

13. A high-strength pintle anchoring system as described in claim 6 wherein said inner wythe is a dry wall structure having wallboard panels mounted on columns or framing members, said wall anchor further comprising:

a surface-mounted sheetmetal bracket fixedly attached to said columns of said inner wythe, said sheetmetal bracket being L-shaped and having a mounting portion and an extending portion for extending substantially horizontally into said cavity, said extending portion with said one or more receptor portions therethrough.

14. A high-strength pintle anchoring system as described in claim 13 wherein said one or more receptors further comprise an elongated aperture.

15. A high-strength pintle anchoring system as described in claim 14 wherein said elongated aperture is shaped substantially similar to the cross section of said ribbon pintles; and wherein the width of said ribbon pintles is in a close fitting functional relationship with the opening of said aperture and the widths of said ribbon pintles are substantially normal to said wallboard panels.

16. A high-strength pintle anchoring system as described in claim 15 wherein the distance between each said securement portion is dimensioned to be greater than the diameter of each said opening of said one or more receptor portions.

17. A high-strength pintle anchoring system as described in claim 16, wherein said anchoring system further comprises:

a reinforcement wire disposed in said bed joint; and, wherein said veneer tie insertion portion further comprises:

one or more housings each having a clamping jaw for receiving said reinforcement wire;

whereby, upon installation of said anchoring system with an interconnected reinforcing wire in said outer wythe, said system provides a high degree of seismic protection.

18. A high-strength pintle anchoring system as described in claim 17 wherein said ribbon pintles are compressively reduced in thickness up to 75% of an original diameter thereof.

19. A high-strength pintle anchoring system as described in claim 18, wherein said ribbon pintles are fabricated from 0.172- to 0.312-inch diameter wire and when reduced by one-third have a tension and compression rating at least 130% of the rating for a non-reduced pintle.

20. A high strength pintle veneer tie as described in claim 1 wherein the cavity portions are free of compressive reduction.

* * * * *